US007294006B1

(12) United States Patent
Chen

(10) Patent No.: US 7,294,006 B1
(45) Date of Patent: Nov. 13, 2007

(54) DEPRESSION-TO-RELEASE BULB SOCKET

(76) Inventor: Chuan-Ying Chen, No. 27, Lane 299, Hsi Men St., Hsinchu (TW)

( * ) Notice: Subject to any disclaimer, the term of this patent is extended or adjusted under 35 U.S.C. 154(b) by 0 days.

(21) Appl. No.: 11/534,224

(22) Filed: Sep. 22, 2006

(51) Int. Cl.
*H01R 4/38* (2006.01)

(52) U.S. Cl. ..... 439/257; 439/668; 439/340

(58) Field of Classification Search ..... 439/257, 439/256, 666, 667, 665, 340, 668
See application file for complete search history.

(56) References Cited

U.S. PATENT DOCUMENTS 1,104,577 A * 7/1914 Thomas ..... 439/257

* cited by examiner

*Primary Examiner*—Javaid H. Nasri
(74) *Attorney, Agent, or Firm*—Leong C. Lei

(57) ABSTRACT

A socket bulb includes a shell inside which a depression device, a clamp device, and conductive plates are arranged. The shell has a lower opening through which the base of a bulb can be put into the shell in a linear movement. Depression operation of the depression device by the base of the bulb moves the clamp device to move between a raised position and a lowered position. When the clamp device is moved from the raised position to the lowered position, the bulb is securely retained inside the shell in electrical engagement with the conductive plates through which power is supplied to the bulb. When the clamp device is moved from the lowered position to the raised position, the bulb is released and can be withdrawn easily. As such, an efficient and safe structure for mounting and dismounting a bulb in a socket is provided.

5 Claims, 8 Drawing Sheets

DEPRESSION-TO-RELEASE BULB SOCKET

BACKGROUND OF THE INVENTION (a) Technical Field of the Invention

The present invention relates generally to a bulb socket, and in particular to a depression-to-release bulb socket, which allows mounting and dismounting of a bulb to be realized by a single depression of the bulb.

(b) Description of the Prior Art

A conventional lamp bulb comprises a bulb made of for example glass and having a lower end to which a base made of copper alloy and forming a threaded ring contact and a tip contact is mounted. A filament is arranged inside the bulb and is connected to two wires for supplying power to the filament. One of the wires extends out of the bulb and is attached to the ring contact of the base and the other wire is attached to the tip contact to respectively serve as negative and positive electrodes of the lamp bulb. A conventional bulb socket is constructed to receive the lamp bulb therein, comprising an insulation shell in which a conductive and threaded inner shell and a resilient conductive contact are arranged. The inner shell and the resilient contact of the socket are respectively connected to negative and positive terminals of a power source.

The bulb is received in socket in a threading manner by relative rotation therebetween in order to make the ring contact of the bulb engaging the inner shell of the socket and the tip contact of the bulb engaging the resilient contact of the socket. Thus, power can supplied from the external power source through the socket to the bulb. To remove the bulb from the socket, the bulb is rotated in a reversed direction to disengage the ring contact of the bulb from the inner shell of the socket.

The conventional threading type bulb and bulb socket, although effective in securing electrical engagement between the bulb and socket and allowing removal of the bulb from the socket, yet suffers the following disadvantages:

(1) The bulb must be rotated three or four full turns in order to securely fix in the socket and establish electrical engagement therebetween or to completely remove the bulb from the socket. This operation is time-consuming and inefficient.

(2) In rotating the bulb to detach the bulb from the socket, it is difficult to very precisely predict when the bulb is completely disengaged from the socket. Further, in doing the rotation, a user's hand, which cannot do a full turn, must repeatedly release and re-hold the bulb. With ignorance of the exact time when the bulb is disengaged from the socket, each time the user's release and re-hold the bulb in order to proceed with the next turn of rotation, it is always a serious concern of the user if the bulb will happen to disengage from the socket and falls when the user's hand just release the bulb. This is especially true is dismounting a large and heavy bulb and especially for a female user, who is usually weak with her hand's muscles. It is due to this reason that some female users still consider changing bulbs very difficult.

(3) If the glass bulb is broken, to remove the broken bulb from the bulb socket is an even more tough job, for the user cannot but to grip the broken glass or to grip a very tiny portion of the ring contact of the broken bulb that is exposed outside the socket and this often injure the user by being cut by the broken glass. Alternatively, a hand tool must be used to grip the base of the broken bulb in order to apply torque to the bulb. This is certainly troublesome and dangerous.

Thus, it is desired to have a bulb socket to allow an existing bulb having a threaded base to be secured and released in a more efficient and safer manner.

SUMMARY OF THE INVENTION

The primary purpose of the present invention is to provide a bulb socket, which allow a bulb to be secured therein or removed therefrom by a single operation of depressing the bulb so that mounting and removal of the bulb can be carried out in an efficient and safe manner.

To achieve the above objective, in accordance with the present invention, there is provided a depression-to-release bulb socket, comprising: a shell defining an interior space delimited by a circumferential side wall and having an open end for entry and receipt of a base of a bulb in the interior space, a stepped flange being provided on an inside surface of the side wall at a location close to the open end, the stepped flange having a converged cross-sectional dimension as compared to the side wall of the shell; a depression device comprising a pushbutton arranged in the interior space of the shell and movable between a first position and a second position by a depression operation; a clamp device mounted to the pushbutton to be movable in unison therewith and having a circumference received in the interior space and a plurality of clamping fingers extending from the circumference in a direction toward the open end of the shell, each clamping finger forming on an inside face thereof at least one catch; and conductive plates arranged inside the shell and having first and second vertical sections respectively, which have lower ends engageable with a ring contact and a tip contact of the base of the bulb when the bulb is received in the shell.

In accordance with the depression-to-release bulb socket of the present invention, by initiating the depression operation of the pushbutton by the base of the bulb in the shell, the pushbutton drives the clamp device between a raised position and a lowered position and releasably retained at the positions. When the clamp device is moved from the raised position to the lowered position, the bulb is retained in a position inside the socket for electrical engagement with the conductive plates and when the clamp device is moved from the lowered position to the raised position, the bulb is allowed to easily withdraw out of the socket. Thus, an efficient and safe structure for mounting and dismounting a bulb in a socket is provided.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
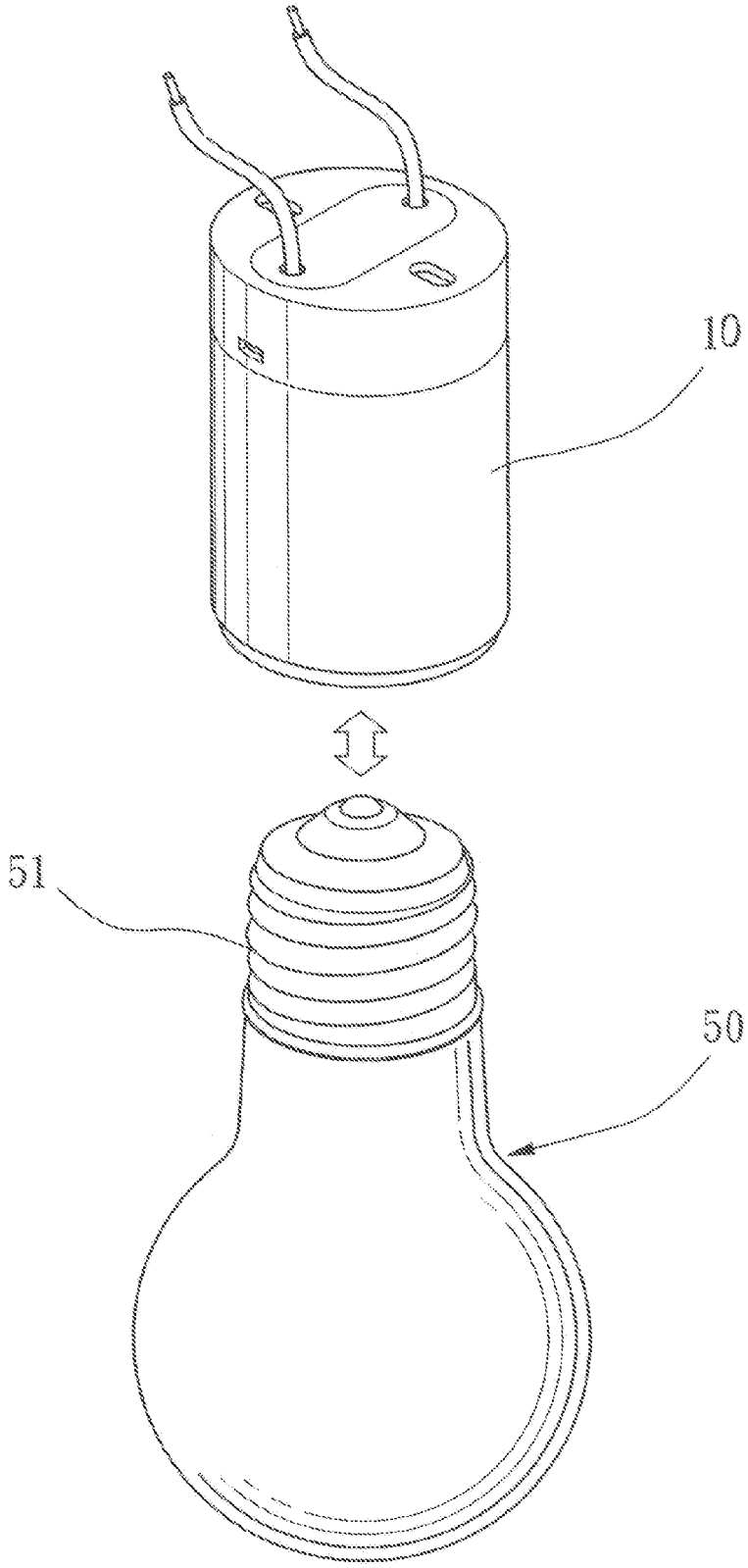
FIG. 1 is a perspective view of a bulb socket constructed in accordance with the present invention, with a bulb to be mounted thereto being shown as well.
Figure 2:
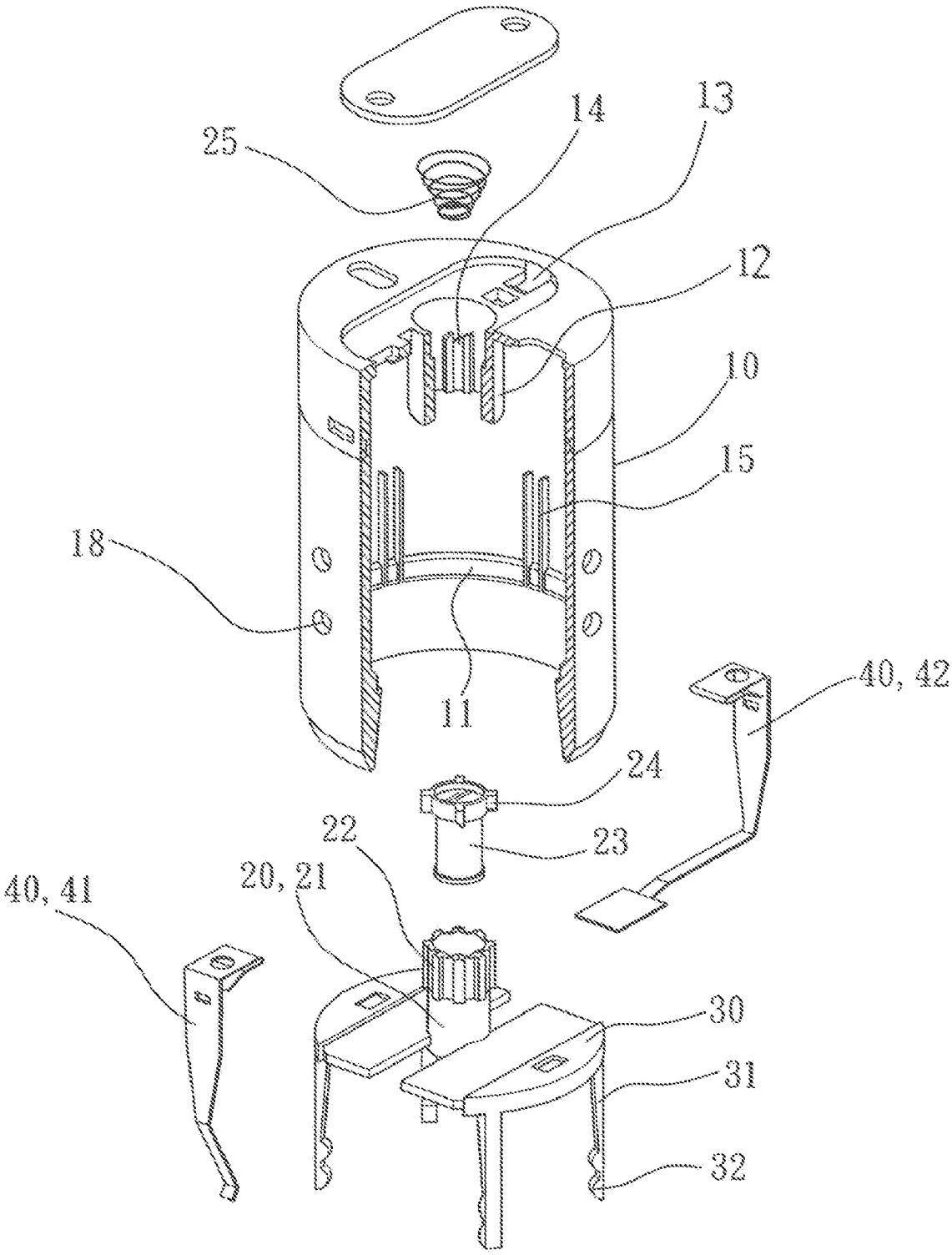
FIG. 2 is an exploded view of the bulb socket of the present invention, a shell of the socket being partially broken to show inside details.
Figure 3:
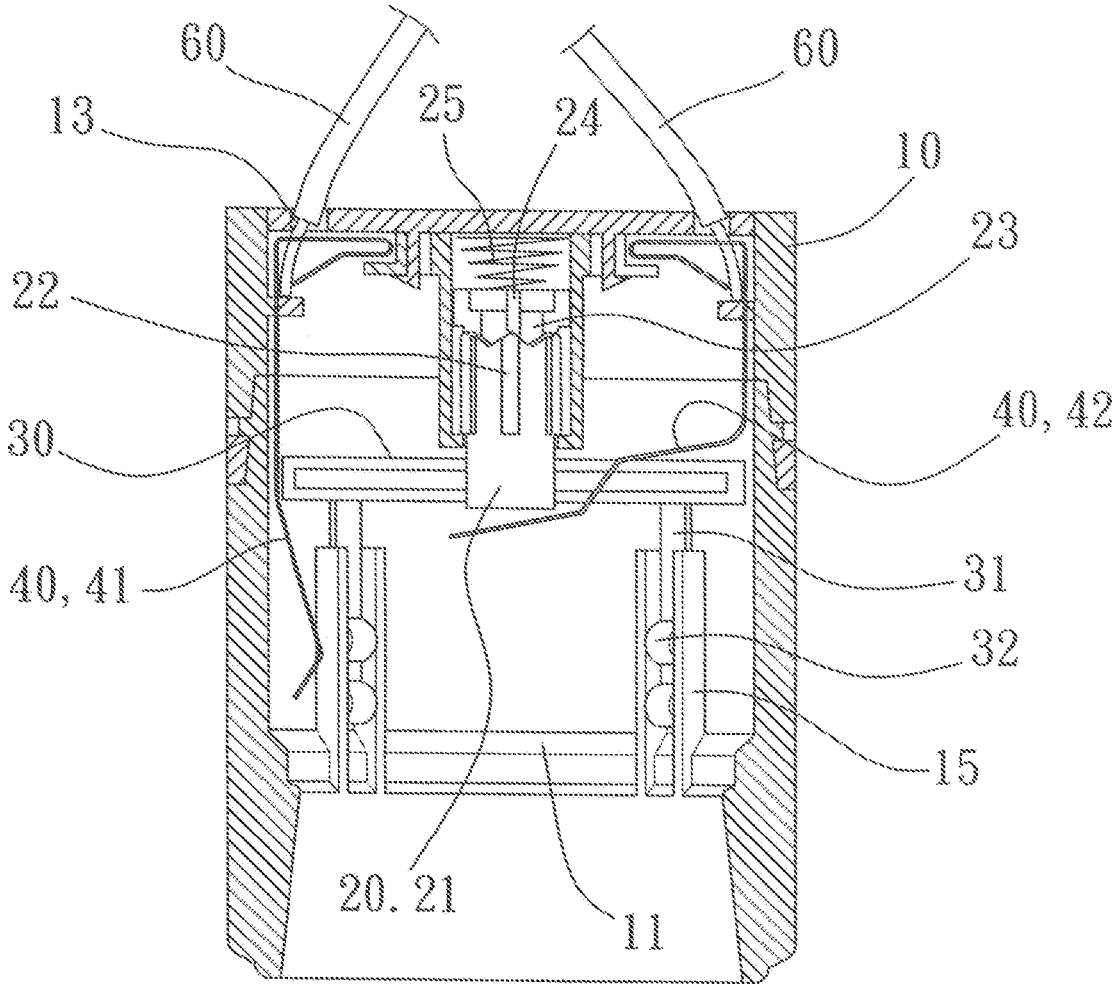
FIG. 3 is a cross-sectional view of the bulb socket of the present invention.

With reference to the drawings, and in particular to FIGS. 1, 2, and 3, a bulb socket constructed in accordance with a first embodiment of the present invention comprises a shell 10 inside which a depression device 20, a clamp device 30, and conductive plates 40 are mounted.

The shell 10 has an open end, which is the lower end as shown in the drawings, but can be put upside down and become the upper end, and an opposite closed end, which is the upper end in the drawings, but can be put upside down and become the lower end. The open end is provided for the entry and receipt of a conductive base 51 of an existing threading type bulb 50 in a linear movement, not rotational movement. A stepped flange 11 is formed in an inside surface of the shell 10 and close to the open end with a converged cross-sectional dimension. A chamber 12 is formed inside the shell 10 and extends inward from the closed end and forming an open end to movably receive the depression device 20 therein. Through holes 13 are defined in the closed end of the shell 10 and preferably on opposite sides of the chamber 12 for the extension of electrical wires 60 therethrough, respectively.

The depression device 20 comprises a shank-like pushbutton 21 movably received in the chamber 12 so that the pushbutton 21 is linearly and axially movable with respect to the chamber 12. The pushbutton 21 is sized to ensure a snugly engagement with the side wall of the chamber 12 for guiding linear movement thereof. A free end of the pushbutton 21 projects beyond the lower open end of the chamber 12 to be engageable by the bulb 50 for applying an actuation force thereto. The pushbutton 21 is axially movable between a first position (or a raised position) where the pushbutton 21 is received more in the chamber 12 with a smaller portion projecting beyond the chamber 12 and a second position (or a lowered position) where the pushbutton 21 is received less in the chamber 12 with a larger portion projecting beyond the chamber 12.

Movement of the pushbutton 21 is realized by providing multiple pairs of ribs (not labeled) of a predetermined length on an inside surface of the side wall of the chamber 12 of the shell 10 and spaced in a circumferential direction, preferably in equally spaced manner. Each pair of ribs delimits a slot therebetween, serving a guide rail 14. The pushbutton 21 has an outer circumferential surface on which axially extending projections 22, serving as slides movably received in the guide rail 14, are formed. A positioner 23 is mounted to a top end of the pushbutton 21 in a rotatable manner and located inside the chamber 12. A spring 25 is arranged between a top end of the positioner 23 and an inner closed end of the chamber 12, but it is apparent that other resilient member can be used instead of the spring 25.

Figure 4:
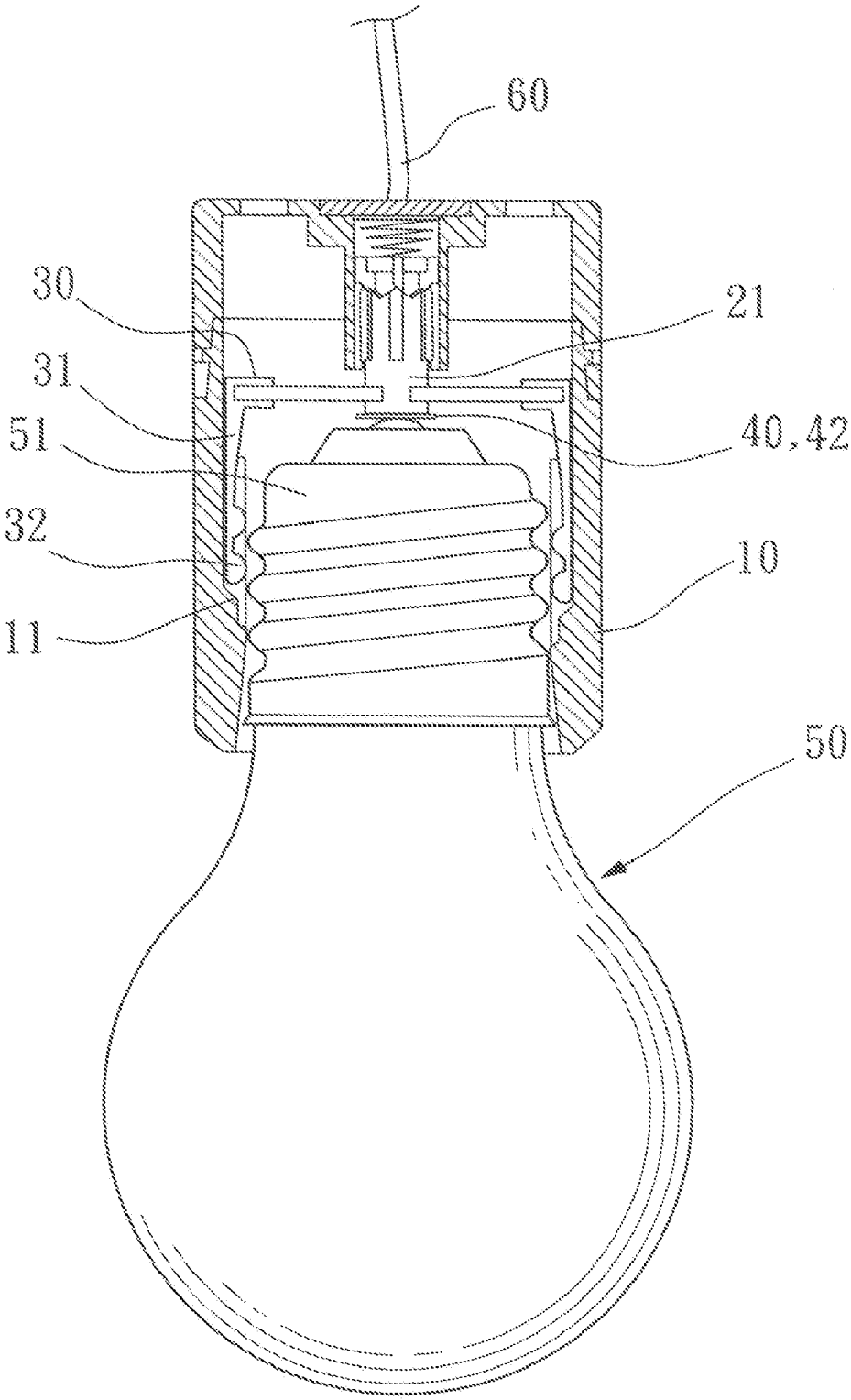
FIG. 4 is a cross-sectional view of the bulb socket of the present invention into which a bulb is being inserted, but not reaching a completely retained position.
Figure 5:
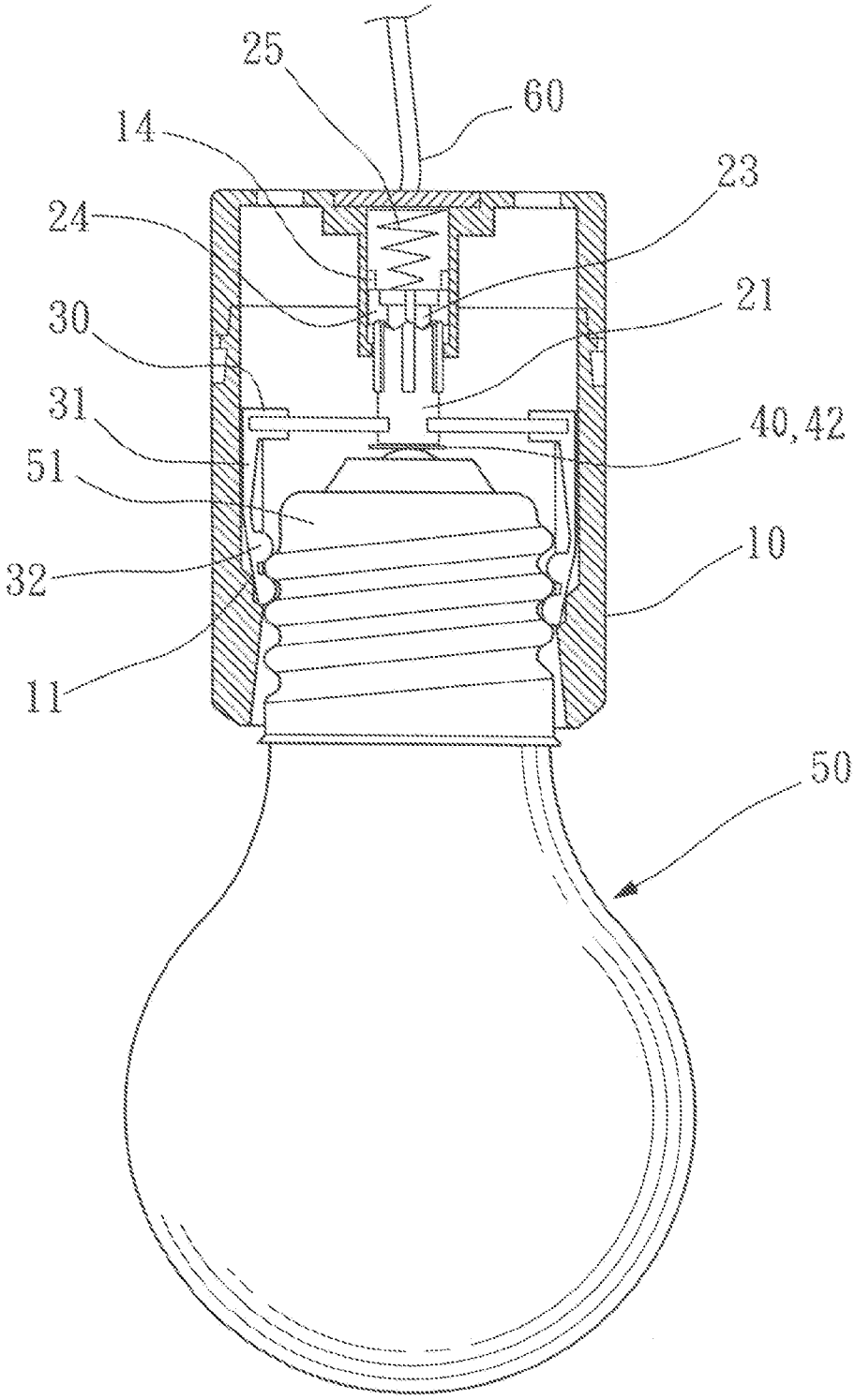
FIG. 5 is similar to FIG. 4 with the bulb secured in a completely retained position.

Referring to FIGS. 3 and 4, when the pushbutton 21 is forcibly moved toward the raised position and then released, the positioner 23 is moved to such a location that sideway extending pawls 24 formed on a circumference of the positioner 23 engages top ends of the ribs that form the guide rails 14, respectively, and are thus retained in position by the top ends of the ribs. Referring to FIG. 5, when the pushbutton 21 is forcibly moved inward again, the pawls 24 are moved to locations corresponding to spacing between the rails 14, and the pushbutton 21 is forced by the biasing force of the spring 25 to move downward to the lowered position.

The clamp device 30 is mounted to a lower end of the pushbutton 21 and is movable in unison with the pushbutton 21. The clamp device 30 comprises a flat body fixed to the pushbutton 21 and an outer circumference substantially corresponding to an interior space of the shell 10. Clamping fingers 31 extend from the outer circumference of the clamp device 30 in a downward direction and each clamping finger 31 has a lower end forming on an inside face thereof inward projections 32, serving as catches. When the pushbutton 21 and the clamp device 30 are located in the raised position, the lower end of the fingers 31 are positioned at a location above the stepped flange 11 of the shell 10 so that the fingers 31 are in an outward expanded condition to allow easy entry of the base 51 of the bulb into the shell 10 in a linear movement. When the pushbutton and the clamp device 30 are in the lowered position, the lower end of the fingers 31 are inward deflected by the stepped flange 11 so that the catches 32 are forced inward to engage the threading of the base 51 of the bulb 50 thereby securing the bulb 50 in the shell 10.

Figure 6:
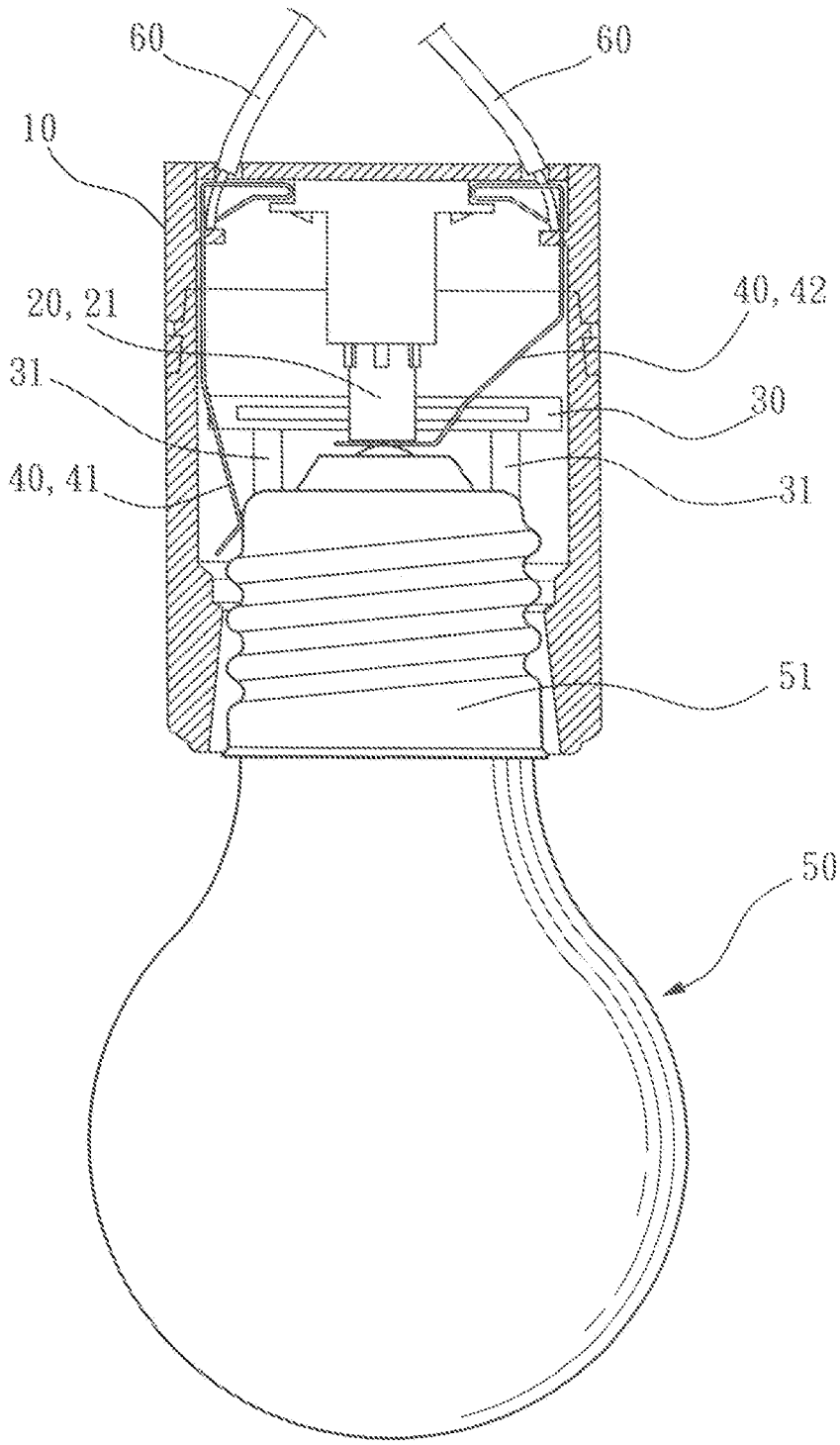
FIG. 6 is another cross-sectional view of FIG. 4 showing electrical connection of the bulb with wires that lead to an external power source.

Referring to FIGS. 2, 3, and 6, the conductive plates 40 are arranged inside the shell 10 at locations corresponding to the through holes 13 and are made in electrical connection with the wires 60. Each conductive plate 40 has a vertical section 41, 42 positioned against and fixed to the inside surface of the shell 10. The first vertical section 41 of the first conductive plate 40 has an inclined lower section that extends into the interior space of the shell 10 to such a location that a free end thereof is engageable with a ring contact portion of the base 51 of the bulb 50 when the bulb 50 is received in the socket. The second vertical section 42 of the second conductive plate 40 has a lower end that is bent so as to have a free end thereof located exactly below the pushbutton 21 for engagement with a top contact of the base 51 of the bulb 50 when the bulb 50 is inserted in to the shell 10. This arrangement also allows the tip contact of the bulb 50 to apply an inward pushing force to the pushbutton 21 through the free end of the second conductive plate 40.

With the pushbutton 21 and the clamp device 30 located at the raised position, to mount the bulb 50 in the socket, the base 51 of the bulb 50 is inserted through the open end into the shell 10 and a force is applied through the bulb 50 to the pushbutton 21 to force the pushbutton 21 and the clamp device 30 inward. The force is then removed to release the bulb, whereby, with the pawls 24 disengaging from the top ends of the rails 14, the pushbutton 21 and the clamp device 30, together with the base 51 of the bulb 50, are biased by the spring 25 to the lowered position where the catches 32 of the clamping finger 31, by being inward deflected by the stepped flange 11, engage threading of the base 51 of the bulb 50 and thus secure the bulb 50 in position and ensure electrical engagement between the base 51 of the bulb 50 and the conductive plates 40. To remove the bulb 50 from the socket, the bulb 50 is pushed inward into the shell 10 to have the pawls 24 of the positioner 23 engage the top ends of the rails 14 again, which maintains the pushbutton 23 and the clamp device 30 in the raised position, where the fingers 31 are moved back to the expanded condition to allow easy withdrawal of the base 51 of the bulb 50 out of the shell 10.

Referring to FIGS. 2 and 3, preferably, guide rails 15 are formed on the inside surface of the shell 10 for respectively and movably receiving the clamping fingers 31 therein. This ensures stability and proper positioning of the clamping fingers 31 during the movement thereof with the pushbutton 21 between the raised position and the lowered position.

Figure 7:
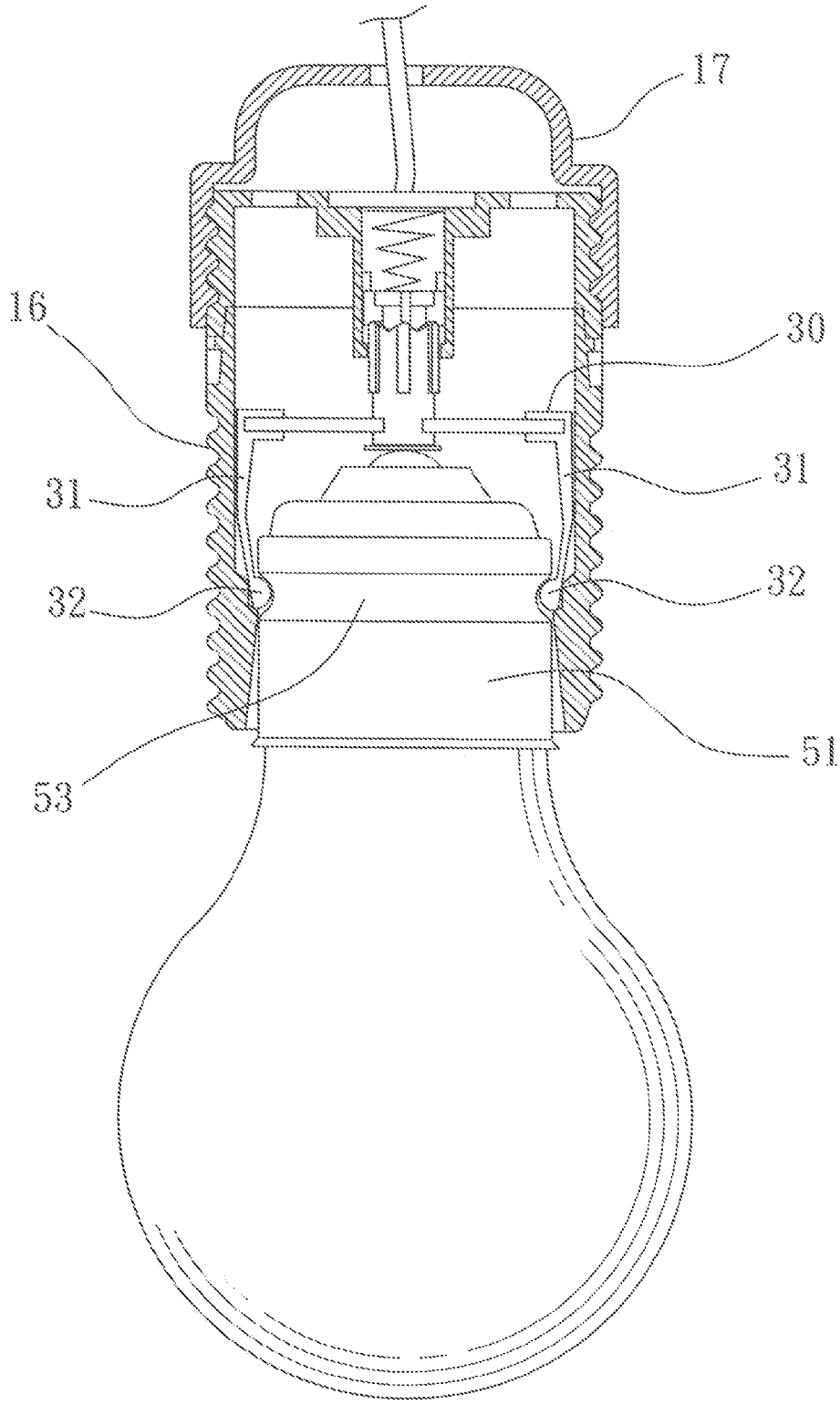
FIG. 7 is a cross-sectional view similar to FIG. 5 but showing another embodiment of the bulb socket of the present invention.

With reference to FIG. 7, an external threading 16 is selectively formed on an outer surface of the shell 10 for engagement with and coupling to a connection device 17, which can be for example a cap of the socket. Also, venting holes 18 are formed in the side wall of the shell 10 for air circulation and heat dissipation.

Further, although multiple catches 32 that are formed for engaging threading of a bulb are demonstrated in the previous embodiments, a single projection can be formed on the lower end of each clamping finger 31 to serve as the catch and all the single projections are of substantially the same altitude. This allows the catches of the clamping fingers 31 to precisely and snugly engage a circumferentially-extending groove 53 defined in a base 51 of a horizontally-grooved bulb, and the present invention can be further applicable to the horizontally-grooved bulb.

Figure 8:
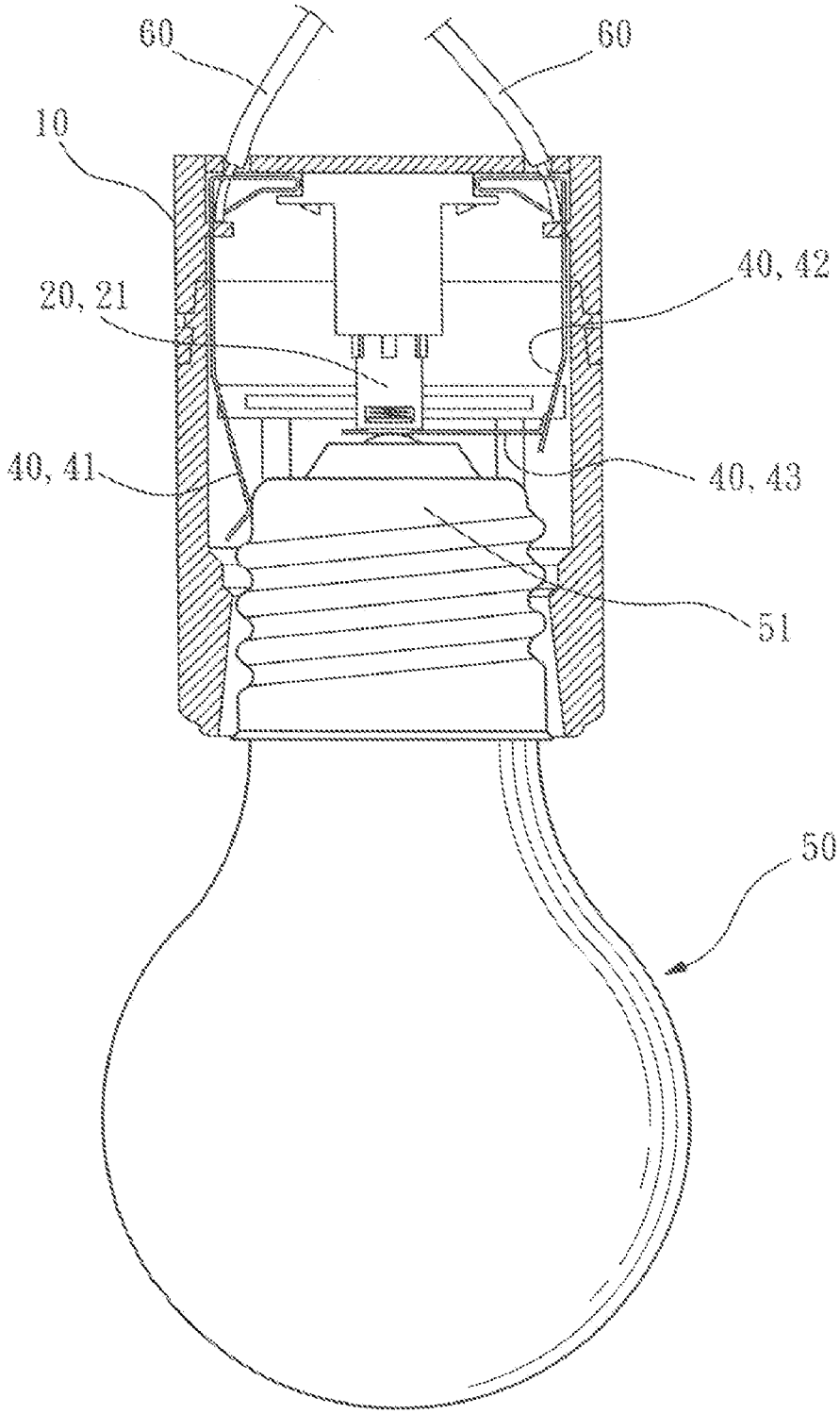
FIG. 8 is a cross-sectional view similar to FIG. 5 but showing a further embodiment of the bulb socket of the present invention.

Referring to FIG. 8, the conductive plates 40 can be arranged in such a manner that the first and second vertical sections 41, 42 are fixed on the inside surface of the shell 10 at locations corresponding to the through holes 31 of the shell 10 and in electrical connection with the wires 60 and that the first vertical section 41 has a free end engageable with the ring contact of the base 51 of a bulb fit into the socket and the second vertical section 42 is not engageable with the base 51 of the bulb. A conductive cross member 43 is mounted to the underside of the pushbutton 21 and is engageable with the tip contact of the base 51 of the bulb. When the pushbutton 21 is moved to the raised position, the cross member 43 is brought into engagement with the second vertical section 42 of the conductive plate 40 and when the pushbutton 21 is moved back to the lowered position, the engagement between the cross member 43 and the second vertical section 42 of the conductive plate 40 is broken. This enhances operation safety for power can only be supplied when the bulb is properly installed. Power cannot be supplied before the bulb is properly secured and thus heating of the bulb during an incomplete installation process is prevented from occurring and the user's hand is protected from being burnt or discomfort caused by the heating.

Although the present invention has been described with reference to the preferred embodiments thereof, it is apparent to those skilled in the art that a variety of modifications and changes may be made without departing from the scope of the present invention which is intended to be defined by the appended claims. For example, the depression device 20 can be replaced with any known depression-to-release/secure means, while still effecting the same function of securing and releasing a bulb in the socket of the present invention by depression and movement of the bulb between a raised position and a lowered position.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A bulb socket comprising:

a shell defining an interior space delimited by a circumferential side wall and having an open end for entry and receipt of a base of a bulb in the interior space, a stepped flange being provided on an inside surface of the side wall at a location close to the open end, the stepped flange having a converged cross-sectional dimension as compared to the side wall of the shell;

a depression device comprising a pushbutton arranged in the interior space of the shell and movable between a first position and a second position by a depression operation;

a clamp device mounted to the pushbutton to be movable in unison therewith and having a circumference received in the interior space and a plurality of clamping fingers extending from the circumference in a direction toward the open end of the shell, each clamping finger forming on an inside face thereof at least one catch; and first and second conductive plates fixed inside the shell and having first and second vertical sections respectively, which are engageable with a ring contact and a tip contact of the base of the bulb when the bulb is received in the shell; and wherein by initiating the depression operation of the pushbutton by inserting the base of the bulb into the shell, the pushbutton and the clamp device are moved from the first position to the second position where the clamping fingers are forced inward by the stepped flange to have the catch engaging the base and thus retaining the bulb in a position for electrical engagement with the conductive plates and wherein when the pushbutton and the clamp device are moved from the second position to the first position, the clamping fingers are allowed to move to an outward expanded condition to allow the base to easily withdraw out of the shell.

2. The bulb socket as claimed in claim 1, wherein each clamping finger has a single catch and wherein all the catches are located at substantially the same altitude for smoothly engaging a horizontal groove defined in a base of a bulb.

3. The bulb socket as claimed in claim 1, wherein the shell has an outer circumferential surface in which threading is formed for coupling to an external connection device.

4. The bulb socket as claimed in claim 1, wherein the side wall of the shell defines at least one venting hole for heat dissipation.

5. The bulb socket as claimed in claim 1, wherein the first conductive plate has an extension electrically engageable with said ring contact of the base of the bulb, and wherein a conductive cross member is mounted to an underside of the pushbutton and is engageable with said tip contact of the base of the bulb, the conductive cross member being engageable with the second conductive plate when the pushbutton is in the second position and being disengageable from the second conductive plate when the pushbutton is in the first position.

* * * * *